US005810431A

United States Patent [19]

Gibson

[11] Patent Number: 5,810,431

[45] Date of Patent: Sep. 22, 1998

[54] LOW PROFILE RECLINER AND RECLINING MECHANISM

[76] Inventor: Andrew C. Gibson, 1821 W. Friendly Ave., Greensboro, N.C. 27403

[21] Appl. No.: 730,447

[22] Filed: Oct. 15, 1996

[51] Int. Cl.[6] ..... A47C 1/02

[52] U.S. Cl. ..... 297/85; 297/68

[58] Field of Search ..... 297/85, 68, 83, 297/84, 342, 423.19, 423.1, 452.18, 463.1

[56] References Cited

U.S. PATENT DOCUMENTS

| | | | |
|---|---|---|---|
| 3,637,255 | 1/1972 | Re | 297/85 |
| 3,730,585 | 5/1973 | Rogers, Jr. et al. | 297/85 |
| 3,802,735 | 4/1974 | Re | 297/85 |
| 3,926,472 | 12/1975 | Evans | 297/88 |
| 4,226,473 | 10/1980 | Johnson | 297/316 |
| 4,826,243 | 5/1989 | Lawson | 297/85 |
| 5,169,208 | 12/1992 | Re et al. | 297/85 |
| 5,217,276 | 6/1993 | LaPointe et al. | 297/85 |
| 5,374,101 | 12/1994 | Wiecek | 297/85 |
| 5,485,979 | 1/1996 | LaPointe et al. | 248/188.2 |

*Primary Examiner*—Milton Nelson, Jr.
*Attorney, Agent, or Firm*—Rhodes, Coats & Bennett, L.L.P.

[57] ABSTRACT

A recliner selectively transitionable between an upright position and a reclined position. The recliner includes a seat having a front, upper edge, a rear edge, and a pair of opposed side edges extending between the front, upper edge and the rear edge. A foot rest is disposed below the seat when the recliner is in the upright position. A seat back extends upwardly from the seat and has a front surface adjacent the rear edge of the seat. A pair of upright arms are each disposed adjacent a respective side edge of the seat. When the recliner is in the upright position the recliner has a vertical height from the support surface to the front, upper edge of from about 16.5 to about 18.5 inches, and a horizontal depth from the front, upper edge of the seat to the front surface of the seat back of from about 21 to about 25 inches. Moreover, the ratio of the height to the depth is from about 1.1 to about 1.5.

13 Claims, 4 Drawing Sheets

LOW PROFILE RECLINER AND RECLINING MECHANISM

FIELD OF THE INVENTION

The present invention relates generally to an improved reclining chair, or recliner, and in particular to a recliner having the appearance and comfort of a standard upholstered chair.

BACKGROUND OF THE INVENTION

Recliners are widely used and enjoyed because they can be adjusted from an upright position to a reclined position with the back being positioned in a more reclined and comfortable position. Also, a foot rest can be raised at the front of the chair seat, either along with reclining of the chair back or separately, to support the user's legs.

However, recliners designed prior to the present invention are often uncomfortable, especially when in the upright position, due to the height and depth of the seat. This discomfort is particularly noticeable by users of smaller and larger physical dimensions, since the user's feet will not always extend to the floor or the seat is too shallow when the recliner is in its upright position. Also, recliners have historically had a large, bulky appearance, and thus do not fit into decorating schemes, particularly with newer furniture designs that tend to be smaller and of a lower profile. In general, such recliners do not accommodate the current, more casual way of living.

These defects are attributable to the historical design of recliners that has used a relatively high seat and shallow seat depth in comparison to conventional seating. This design, in turn, has resulted from the need to house a mechanism used in reclining the chair beneath the seat.

A recliner is comprised of a generally horizontal seat, a back extending upwardly from the rear of the seat, a pair of spaced arms on either side of the seat, a foot rest, and an operating mechanism positioned beneath the seat and attached to the seat, back, arms and foot rest. A handle or other actuator may also be present, e.g, extending from an arm of the recliner, for use in actuating at least a part of the mechanism. In most designs, the seat, back, arms and foot rest of the chair will be upholstered.

In conventional recliner designs, the level of the seat, i.e., the distance from approximately the front, upper edge of the seat to the floor is from about 19 to about 23 inches. The depth of the seat, i.e., the horizontal distance along the seat cushion from the front, upper edge of the seat to the recliner back, is from about 18 to about 20 inches. This seat depth is not only to minimize the appearance of bulkiness, but more importantly is necessary to improve the comfort of the user, since the user, as a result of the considerable seat height, will tend to sit forward in the recliner in order to reach the floor, and the shorter seat depth aids the user in also touching the seat back. These dimensions are measured with the recliner in the upright position, and will change when the recliner is moved to the reclined position.

The mechanism supporting the seat, back and foot rest between the recliner arms, and allowing the seat, back and foot rest to move between an upright position and a reclining position, is comprised of a first section attached between one arm of the recliner and the adjacent sides of the seat, back and foot rest, and a second section attached to the other arm of the recliner and the opposite sides of the seat, back and foot rest.

The second section of the mechanism is a mirror image of the first section. Therefore, only the first section will be described herein in detail, with it being understood by one skilled in the art that the components and operation of the second section will be the same. The mechanism may also include connection means between the first and second sections, so that the sections function together.

Various operating mechanisms have been designed to control movement of the recliner elements between the upright and reclined positions. Generally, however, these operating mechanisms are comprised of the same basic elements; namely, a seat mounting bracket, a back mounting bracket, a foot rest mounting bracket, arm mounting plates, and a connecting linkage operably joining the other elements of the mechanism.

SUMMARY OF THE INVENTION

According to the present invention, it has been found that the comfort of the recliner, as well as its appearance, can be substantially improved by reconfiguring the dimensions of a recliner to certain defined sizes and ratios, measured when the recliner is in the upright position. More specifically, it has been determined that a recliner with improved comfort and appearance is achieved if the height of the seat (i.e., the distance from the floor or the plane defined by the bottom of the chair legs or supports to the front, upper edge of the seat) is at or below about 18.5 inches and the depth of the chair seat (i.e., the horizontal distance from the front, upper edge of the seat to the front surface of the recliner back) is at least 21 inches. Optimum comfort is achieved when the height of the seat is between about 16.5 inches and 18.5 inches, and preferably 17 to 18 inches, and the depth of the chair seat is between about 21 inches and 25 inches, and preferably 22 to 24 inches.

The relationship of seat height to seat depth is also critical. Recliners with larger overall dimensions will ordinarily be larger in certain dimensions, while smaller recliners will be relatively smaller in these dimensions. Thus, in order to construct a recliner with the desired "comfort zone" it is also important to take into account the ratio of these two parameters. It has been determined that the comfort level of the chair is at its greatest when the ratio of seat depth to seat height is between about 1.1 and 1.5, and preferably between about 1.2 and 1.4. Moreover, it has been found that the greatest comfort level is achieved when the sum of the height and the depth is between about 39 inches and 42 inches, and preferably between about 40 inches and 41 inches.

Other dimensions of the recliner will depend upon the particular style of the recliner being constructed, and will be selected to provide a recliner having an overall pleasing appearance. Generally, the seat width will be from about 18 to about 24 inches; the seat back height from about 20 to about 27 inches, and the arm height from about 20 to about 27 inches.

Thus, it is an aspect of the present invention to provide an improved recliner having an upright position and a reclined position with the seat of the recliner, when the recliner is in an upright position, having a height of from about 16.5 to about 18.5 inches and a depth of from about 21 to about 25 inches.

It is especially an aspect of the invention to provide a recliner having the dimensions above in which the ratio between the seat depth and the seat height is between about 1.1 and 1.5.

Finally, it is an objective of the invention to provide a low-profile recliner having an upright position and a reclined position comprising a seat back movable between a generally vertical position and a generally horizontal position; a seat having a horizontal depth from a front, upper edge of the seat of from about 21 to about 25 inches, and the seat having a height, as measured vertically from the floor to the upper, front edge of the seat, being from about 16.5 to about 18.5 inches; a foot rest having generally vertical position beneath the seat front edge and an extended, generally horizontal position; first and second spaced upright arms; and an operating mechanism secured to the arms and supporting the seat back, the seat and the foot rest.

Other features of the invention will be apparent to one skilled in the art upon a reading of the detailed description of the invention which follows, taken together with the drawings.

DETAILED DESCRIPTION OF THE PREFERRED EMBODIMENT

In the following description, terms such as horizontal, upright, vertical, above, below, beneath, and the like, are used solely for the purpose of clarity in illustrating the invention, and should not be taken as words of limitation.

Figure 1:
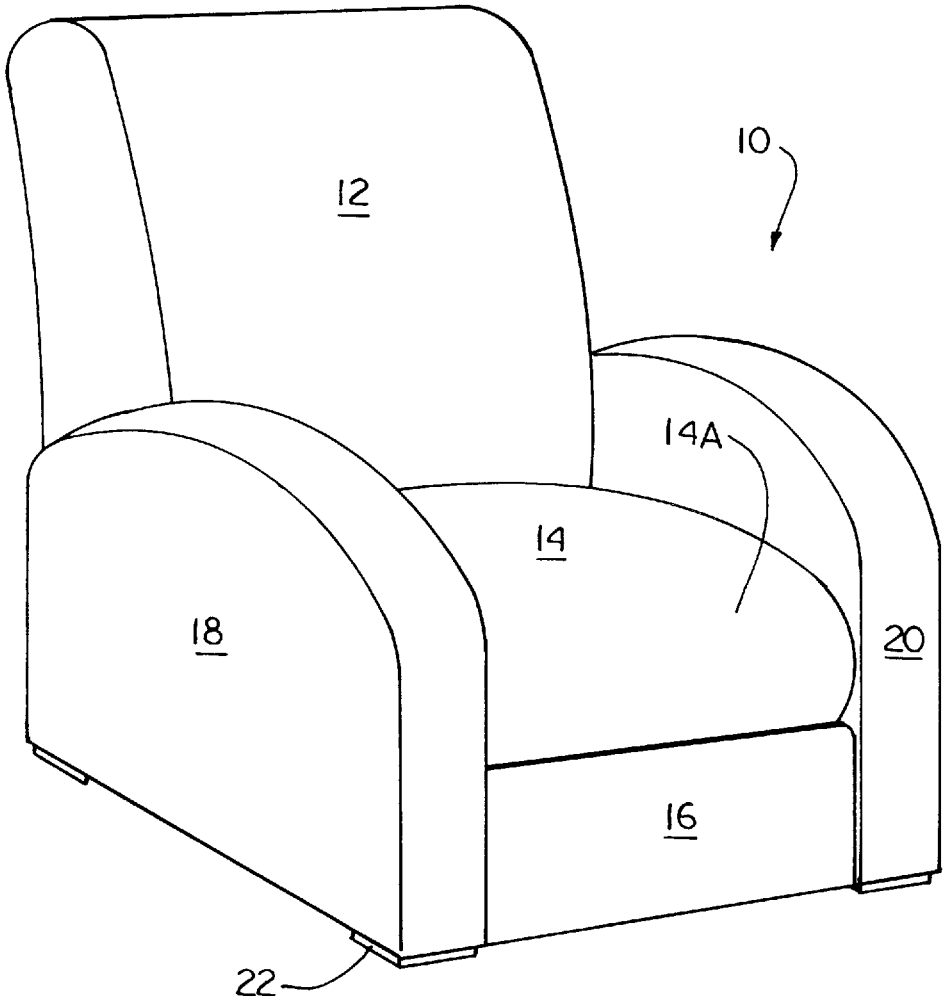
FIG. 1 is a perspective view of the recliner of the invention.

As best illustrated in FIG. 1, the recliner, generally 10, of the invention is comprised of a back 12, a seat 14, a foot rest 16, and arms 18 and 20. Feet 22 support the recliner above the floor 5. Recliner 10 is illustrated in its upright position. Back 12, seat 14 and foot rest 16 are supported on arms 18 and 20 by an operating mechanism, generally 24, shown in FIG. 3.

Figure 2:
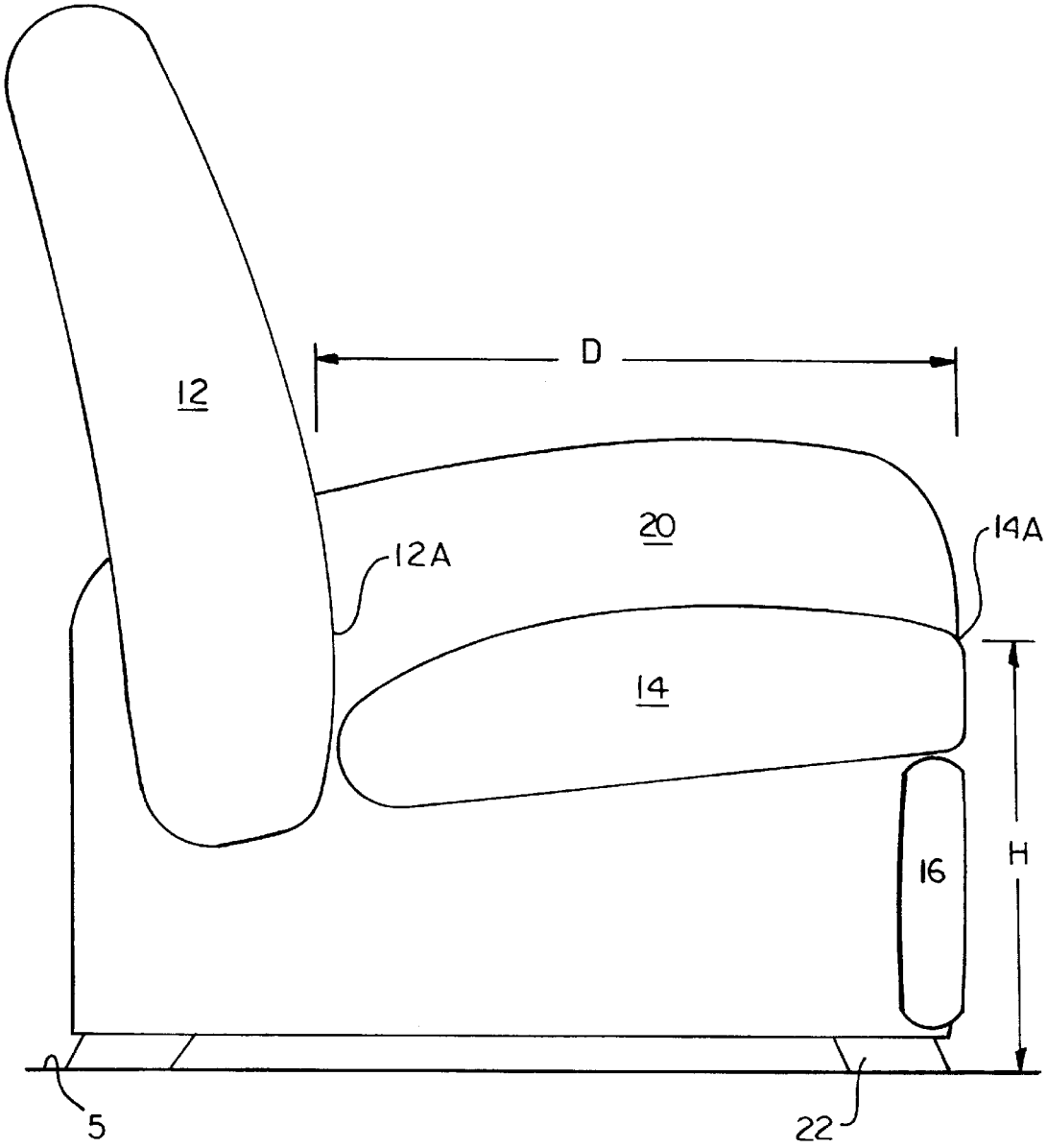
FIG. 2 is a schematic side view of the recliner of the invention, with arms and operating mechanism removed to illustrate the dimensional measurements of the recliner.

FIG. 2 is a schematic illustration of the side view of recliner 10, illustrating the measurement made to determine the height "H" of the seat, as measured from the floor 5 or other surface supporting the recliner to the upper, front edge 14A of recliner seat 14. As shown, height "H" includes the height of feet 22. The measurement of the depth "D" of the seat from the front surface 12A of seat back 12 adjacent seat 14 to the upper, front edge 14A of seat 14 is also illustrated.

Figure 3:
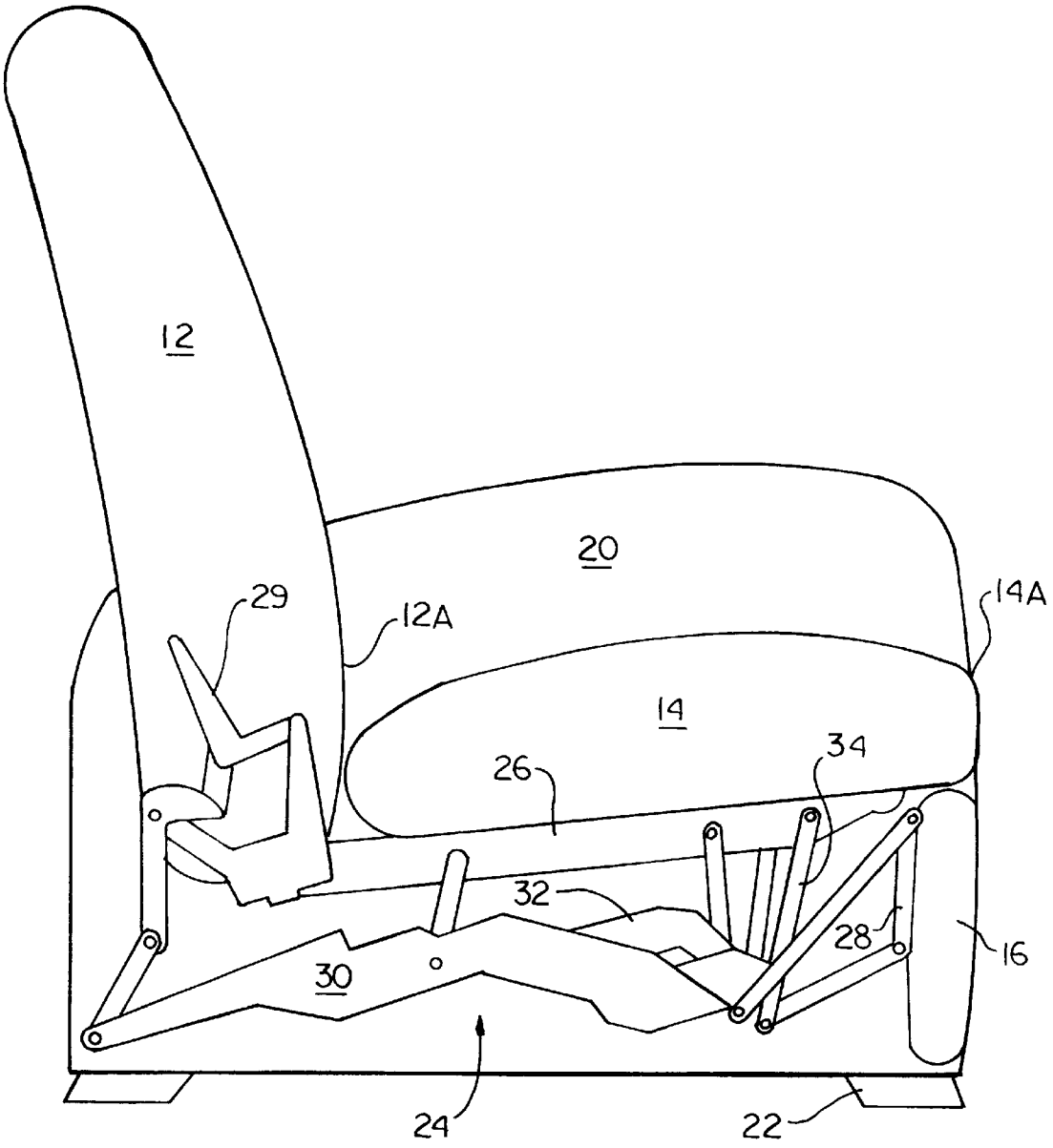
FIG. 3 is a side view of the recliner, with one arm removed for purposes of illustrating the operating mechanism.

As shown in FIG. 3, the near section of operating mechanism 24 is comprised of a seat mounting bracket 26, a back mounting bracket 29 pivotally secured to the rear of bracket 26, a foot rest mounting bracket 28, and an arm mounting plate 30. A connecting linkage, generally 32, operably joins seat bracket 26 to mounting plate 30, and a scissors linkage 34 joins foot rest bracket 28 to seat bracket 26 and to arm mounting plate 30. When recliner 10 is fully assembled, plate 30 is secured to the inner surface of arm 18, thereby supporting the adjacent sides of seat back 12, seat 14 and foot rest 16. A second section of mechanism 24 is secured to arm 20 to support the opposite sides of seat back 12, seat 14 and foot rest 16. When recliner back 12 is moved to the reclined positioned by pressure from the user's back, seat 14 moves forward moving seat mounting bracket 26 to a lower height as a result of the pivoting of linkage 32. Foot rest 16 can be independently extended and pivoted to the horizontal position by extension of scissors mechanism 34.

The operating mechanism of the present invention differs from the operating mechanism of a conventional recliner in two important respects. First, arm mounting plate 30 and seat mounting bracket 26 are each extended to be about 1 to about 5 inches longer than the corresponding components of an otherwise identical recliner, depending on the intended depth D. As a result, arm mounting plate 30 is preferably in the range of from about 24.5 to about 28.5 inches, and seat mounting bracket 26 is preferably in the range of from about 28.5 to about 32.5 inches. Also, the mechanism is mounted at a lower point on arms 18 and 20, so that seat 14 is at a lower position.

Figure 4:
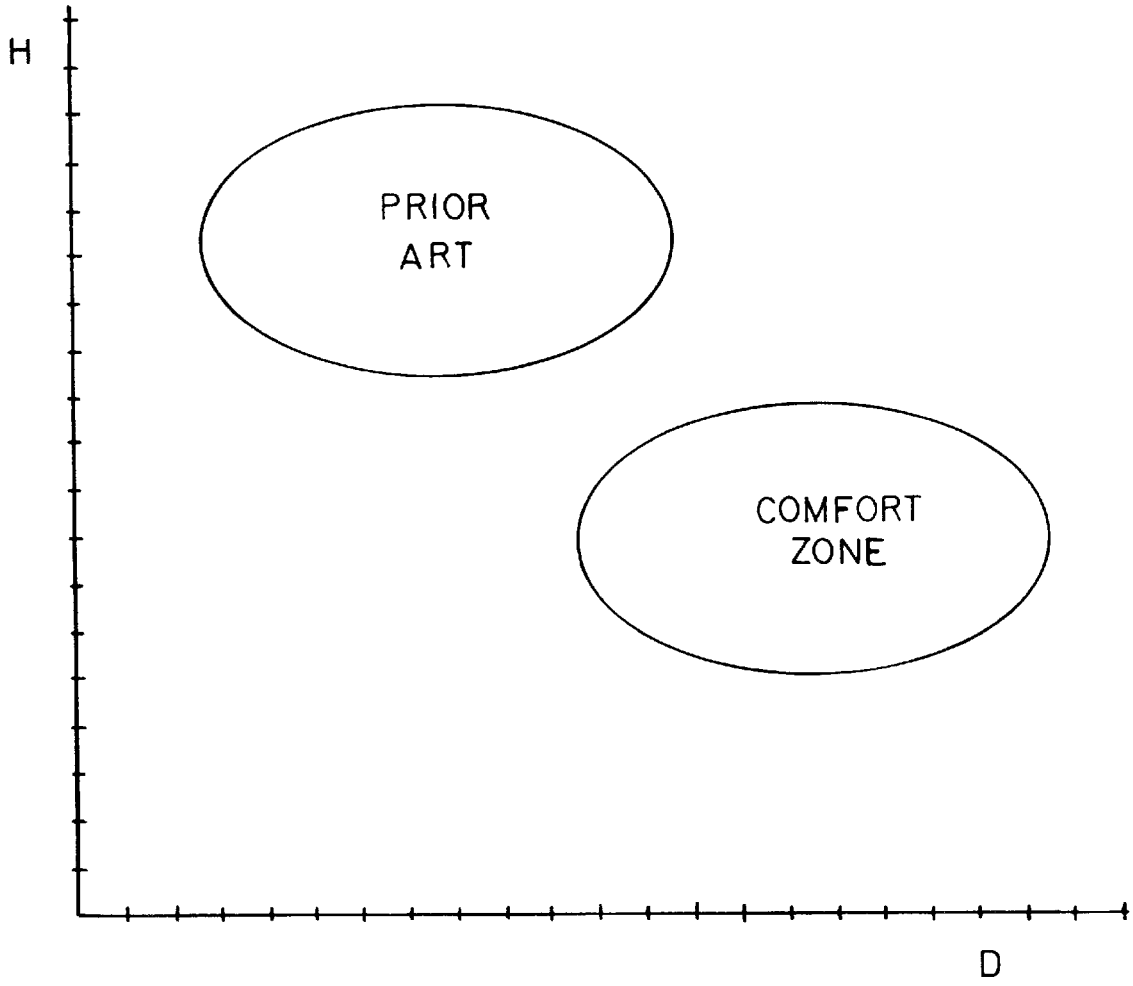
FIG. 4 is a graphic illustration showing the comfort zone of the invention in comparison with the zone experienced with a conventional recliner.

As noted earlier, the present invention results in a recliner that not only has a lower, more appealing profile, but also results in a recliner that is more comfortable to the user. The seat height and depth parameters of the present recliner in comparison to the corresponding parameters of a conventional recliner are graphically illustrated in FIG. 4. As noted from the graph, the "comfort zone" of the present invention is distinct from the zone defined by corresponding prior art dimensions.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A recliner for placement on a substantially planar support surface, said recliner selectively transitionable between an upright position and a reclined position, said recliner comprising:

a) a seat having a front, upper edge, a rear edge, and a pair of opposed side edges extending between said front, upper edge and said rear edge;

b) a foot rest disposed below said seat when said recliner is in said upright position;

c) a seat back extending upwardly from said seat and having a front surface adjacent said rear edge of said seat;

d) a pair of upright arms each disposed adjacent a respective side edge of said seat; and e) wherein, when said recliner is in said upright position:

i) said recliner has a vertical height from the support surface to said front, upper edge of said seat of from substantially 16.5 to substantially 18.5 inches;

ii) said recliner has a horizontal depth from said front, upper edge of said seat to said front surface of said seat back of from substantially 21 to substantially 25 inches; and iii) the ratio of said depth to said height is from substantially 1.1 to substantially 1.5.

2. The recliner of claim 1 wherein the sum of said height and said depth is from substantially 39 to 42 inches.

3. The recliner of claim 1 wherein said height is from substantially 17 to 18 inches, and said depth is from substantially 22 to 24 inches.

4. The recliner of claim 3 wherein said ratio is from substantially 1.2 to 1.4.

5. The recliner of claim 4 wherein the sum of said height and said depth is from substantially 40 to 41 inches.

6. The recliner of claim 1 further including an operating mechanism operative to transition said recliner between said upright and reclined positions, said operating mechanism including:

a) a seat mounting bracket secured to said seat;

b) a back mounting bracket pivotally secured to a rear portion of said seat mounting bracket and to said seat back;

c) a foot rest mounting bracket secured to said foot rest;

d) an arm mounting plate secured to one of said arms;

e) a connecting linkage joining said seat mounting bracket to said arm mounting plate; and f) a scissors linkage joining said foot rest bracket to said seat mounting bracket and to said arm mounting plate.

7. The recliner of claim 6 wherein said seat mounting bracket has a first length of from substantially 28.5 to substantially 32.5 inches, and said arm mounting plate has a second length of from substantially 24.5 to substantially 28.5 inches.

8. An operating mechanism for a recliner of the type having a seat, a seat back, a pair of opposed arms, and a foot rest, and transitionable between an upright position and a reclined position, said operating mechanism comprising:

a) a seat mounting bracket securable to the seat;

b) a back mounting bracket pivotally securable to a rear portion of said seat mounting bracket and to the seat back;

c) a foot rest mounting bracket secured to the foot rest;

d) an arm mounting plate secured to one of the arms;

e) a connecting linkage joining said seat mounting bracket to said arm mounting plate;

f) a scissors linkage joining said foot rest bracket to said seat mounting bracket and to said arm mounting plate; and g) wherein said seat mounting bracket has a first length of from substantially 28.5 to substantially 32.5 inches, and said arm mounting plate has a second length of from substantially 24.5 to substantially 28.5 inches.

9. A recliner for placement on a substantially planar support surface, said recliner selectively transitionable between an upright position and a reclined position, said recliner comprising:

a) a seat having a front, upper edge, a rear edge, and a pair of opposed side edges extending between said front, upper edge and said rear edge;

b) a seat back extending upwardly from said seat and having a front surface adjacent said rear edge of said seat; and c) wherein, when said recliner is in said upright position:

i) said recliner has a vertical height from the support surface to said front, upper edge of from substantially 16.5 to substantially 18.5 inches; and ii) said recliner has a horizontal depth from said front, upper edge of said seat to said front surface of said seat back of from substantially 21 to substantially 25 inches.

10. A recliner for placement on a substantially planar support surface, said recliner selectively transitionable between an upright position and a reclined position, said recliner comprising:

a) a seat having a front, upper edge, a rear edge, and a pair of opposed side edges extending between said front, upper edge and said rear edge;

b) a foot rest disposed below said seat when said recliner is in said upright position;

c) a seat back extending upwardly from said seat and having a front surface adjacent said rear edge of said seat;

d) a pair of upright arms each disposed adjacent a respective side edge of said seat; and e) wherein, when said recliner is in said upright position:

i) said recliner has a vertical height from the support surface to said front, upper edge of said seat and a horizontal depth from said front, upper edge of said seat to said front surface of seat back; and ii) the sum of said vertical height and said horizontal depth being in the range of 39 to 42 inches and the ratio of said seat depth to said seat height is from substantially 1.1 to substantially 1.5.

11. The recliner of claim 10 wherein said ratio is from substantially 1.2 to 1.4.

12. The recliner of claim 10 wherein said sum is from substantially 40 to 41 inches.

13. The recliner of claim 10 wherein said height is from substantially 16.5 to 18.5 inches, and said depth is from substantially 21 to 25 inches.

* * * * *